US011364175B2

(12) United States Patent
Labroc et al.

(10) Patent No.: US 11,364,175 B2
(45) Date of Patent: Jun. 21, 2022

(54) DEVICE FOR COLLECTING A SAMPLE OF A LIQUID CONTAINED IN A CONTAINER, ASSOCIATED CONTAINER, AND USE OF THIS CONTAINER

(71) Applicant: VIRBAC, Carros (FR)

(72) Inventors: Laurie Labroc, Nice (FR); Michel Robin, Antibes (FR); Daniel Aneas, Menetrol (FR)

(73) Assignee: Virbac, Carros (FR)

( * ) Notice: Subject to any disclaimer, the term of this patent is extended or adjusted under 35 U.S.C. 154(b) by 189 days.

(21) Appl. No.: 16/468,980

(22) PCT Filed: Dec. 15, 2017

(86) PCT No.: PCT/EP2017/083162

§ 371 (c)(1),
(2) Date: Jun. 12, 2019

(87) PCT Pub. No.: WO2018/109215

PCT Pub. Date: Jun. 21, 2018

(65) Prior Publication Data

US 2020/0038290 A1 Feb. 6, 2020

(30) Foreign Application Priority Data

Dec. 16, 2016 (FR) ..... 1662671

(51) Int. Cl.

| | |
|---|---|
| ***A61J 1/20*** | (2006.01) |
| ***A61J 1/14*** | (2006.01) |
| ***A61J 1/18*** | (2006.01) |

(52) U.S. Cl.

CPC ..... *A61J 1/2089* (2013.01); *A61J 1/1481* (2015.05); *A61J 1/18* (2013.01); *A61J 1/2031* (2015.05);

(Continued)

(58) Field of Classification Search

CPC ..... A61J 1/1481; A61J 1/2031; A61J 1/2037; A61J 1/2075; A61J 1/2082; A61J 1/18; A61J 1/2089

See application file for complete search history.

(56) References Cited

U.S. PATENT DOCUMENTS

| | | | | |
|---|---|---|---|---|
| 5,425,465 | A | 6/1995 | Healy | |
| 8,171,963 | B2 * | 5/2012 | Sonnier | G01F 11/027 141/27 |

(Continued)

FOREIGN PATENT DOCUMENTS

| | | | |
|---|---|---|---|
| CN | 101815496 | A | 8/2010 |
| CN | 102015014 | A | 4/2011 |

(Continued)

OTHER PUBLICATIONS

Asamura Patent Office, Notice of Reasons for Refusal, Japanese Patent Application No. 2019-532026, dated Aug. 25, 2021. (Year: 2021).*

(Continued)

*Primary Examiner* — Ariana Zimbouski
(74) *Attorney, Agent, or Firm* — Alston & Bird LLP

(57) ABSTRACT

The invention relates in particular to a device (100) for collecting a sample of a liquid in a container, characterized in that it has: a housing (10) with a longitudinal axis (AL); a component (20, 20', 20") comprising: a body (26) provided with at least one channel (21) having a proximal end (21*p*) and a distal end (21*d*); a receptacle (24) fixed with respect to the body (26) and situated in the continuation of the proximal end (21*p*) of said at least one channel (21), said component (20) being mounted rotatably with respect to the housing (10) about the longitudinal axis of this housing (10) between a closure position, in which the distal end (21*d*) of said at least one channel (21) is closed by the housing (10), and an open position, in which the distal end (21*d*) of said (Continued)

at least one channel (21) is able to establish a fluidic communication with the container; and an elastic valve (30) housed in the receptacle (24).

17 Claims, 7 Drawing Sheets

(52) U.S. Cl.
CPC ..... *A61J 1/2037* (2015.05); *A61J 1/2075* (2015.05); *A61J 1/2082* (2015.05)

(56) References Cited

U.S. PATENT DOCUMENTS

| | | | | |
|---|---|---|---|---|
| 2003/0120260 | A1 | 6/2003 | Chu et al. | |
| 2008/0206852 | A1* | 8/2008 | Numajiri | B01L 3/5082 435/287.2 |
| 2011/0175347 | A1* | 7/2011 | Okiyama | A61J 1/2089 285/132.1 |
| 2012/0103468 | A1 | 5/2012 | Terwilliger et al. | |
| 2015/0083950 | A1 | 3/2015 | Okiyama | |

FOREIGN PATENT DOCUMENTS

| | | | |
|---|---|---|---|
| CN | 102196798 | A | 9/2011 |
| CN | 103210347 | A | 7/2013 |
| CN | 104244906 | A | 12/2014 |
| CN | 104334213 | A | 2/2015 |
| EP | 2 351 549 | A1 | 8/2011 |
| JP | 2004275726 | A | 10/2004 |
| JP | A-2010-124898 | | 6/2010 |
| JP | 5 896 228 | B2 | 3/2016 |
| JP | U-3205560 | | 8/2016 |
| JP | A-2016-185361 | | 10/2016 |
| WO | WO 2012/057843 | A1 | 5/2012 |

OTHER PUBLICATIONS

English Translation of Asamura Patent Office, Notice of Reasons for Refusal, Japanese Patent Application No. 2019-532026, dated Aug. 25, 2021. (Year: 2021).*

International Search Report and Written Opinion for Application No. PCT/EP2017/083162 dated Apr. 3, 2018, 9 pages.

* cited by examiner

DEVICE FOR COLLECTING A SAMPLE OF A LIQUID CONTAINED IN A CONTAINER, ASSOCIATED CONTAINER, AND USE OF THIS CONTAINER

CROSS-REFERENCE TO RELATED APPLICATIONS

The present application is a national phase entry of International Application No. PCT/EP2017/083162, filed Dec. 15, 2017, which claims priority to French Application No. 1662671, filed Dec. 16, 2016, the contents of which are incorporated herein by reference in their entirety.

FIELD

The invention concerns a device for sampling (or transferring) a liquid contained in a container.

It also concerns a container equipped with such a sampling device.

It also concerns the use of this container.

The invention is mainly intended for use in the sampling of a liquid exerting medicinal effects, in particular intended for the treatment of animals.

This type of device allows the sampling of a liquid while ensuring, in addition, a tightness.

BACKGROUND

For this purpose, a device for sampling a liquid from a container has already been proposed, including a valve which allows a user, by turning this valve, to close or open a passage between the internal volume of the container and the outside of this container.

When this passage is closed, the liquid contained in the container cannot escape from it. Any leakage of liquid from the inside to the outside of the container is then prevented and the introduction of any external pollution (e. g. unwanted fluid or dust) into the inside of the container is avoided.

When this passage is open, a sampling of the liquid contained in the container can be carried out.

Such a solution is proposed, for example, in document WO 2012/057843 (D1).

However, this solution is not perfect.

Indeed, after a first use, the valve is closed and the upper part of the passage between the external volume and the internal volume of the container remains in contact with the external medium. This upper part of the passage can therefore be loaded with pollutants and in particular load the liquid residues coming from inside the container. Also, when the sampling device is opened later, pollutants may enter the interior of the container. Such pollutants can also be introduced into the container when the valve is open.

Also for this purpose, an alternative solution to the use of a valve is the use of an elastic valve, usually made of an elastomer.

This is for example what is proposed in document U.S. Pat. No. 5,425,465 (D2).

The interest of the elastic valve, in relation to a valve, lies mainly in the absence of a passage zone for the liquid contained in the container in contact with the outside.

However, such an elastic valve is subjected to high and frequent stress, so its service life can be impaired, especially compared to that of a valve.

In addition, with this solution, maintaining a tightness in all cases is complicated. Thus, for example, if the container is spilled, the liquid it contains applies pressure to the elastic valve and leaks can then be detected.

There is therefore a need for an improved device for sampling a liquid from an container.

SUMMARY

For this purpose, the invention proposes a device for sampling a liquid from a container, characterized in that it includes:

- a housing having a longitudinal axis;
- a component including:
  - a body provided with at least one channel with a proximal end and a distal end;
  - a receptacle, fixed with respect to the body, and located in the extension of the proximal end of said at least one channel, said component being mounted in rotation with respect to the housing about the longitudinal axis of this housing between a closing position in which the distal end of said at least one channel is closed by the housing and an opening position in which the distal end of said at least one channel is capable of establishing a fluid communication with the container; and

- an elastic valve housed in the receptacle.

The device according to the invention may also include the following characteristics, taken alone or in combination:

- the elastic valve includes a central orifice, one distal end of which is in fluid communication with the proximal end of said at least one channel of the component and one proximal end of which is in the form of a plug provided with at least one slot;
- the elastic valve is made of elastomer, for example silicone elastomer;
- the component includes a skirt, for example a cylindrical skirt, surrounding the receptacle;
- the body of the component includes a housing and at least one second channel, one proximal end of which opens into the housing, which housing includes an air filter in fluid communication with the outside, and one distal end of which is capable of establishing fluid communication with the container;
- the component includes another housing and at least one third channel, one proximal end of which opens into this other housing, which other housing includes another air filter in fluid communication with the outside, and one distal end of which is capable of establishing fluid communication with the container;
- the distal end of said at least one third channel opens into the housing;
- the or each air filter is hydrophobic and advantageously lipophobic;
- the or each air filter has orifices whose largest dimension is less than or equal to 0.22 μm;
- the housing includes a shutter for closing the distal end of said at least one second channel and/or said at least one third channel when the component is in its closing position;
- the device includes an indicator of the closing or opening position of the component;
- the device further includes a cap detachably mounted on the housing;
- the device includes a tamper indicator of the cap with respect to the housing;
- the housing includes a first base intended to be mounted on the outside of the container; and a second base intended to be mounted on the inside of the container, said second base, which is in one piece or cooperates with the first base, forming the part of the housing with which the component cooperates to move from its closing position to its opening position and vice-versa.

The invention also concerns a container including a liquid and an opening, said container being characterized in that it includes, at its opening, a device for sampling a liquid according to the invention.

The container may include a dip tube in connection with the distal end of the body.

Finally, the invention also concerns the use of a container according to the invention, as a packaging for a liquid consisting of a sterile pharmaceutical composition.

BRIEF DESCRIPTION OF THE DRAWINGS

The invention shall be described more precisely with reference to the attached figures, given in non-restrictive way.

DETAILED DESCRIPTION

Figure 1A:
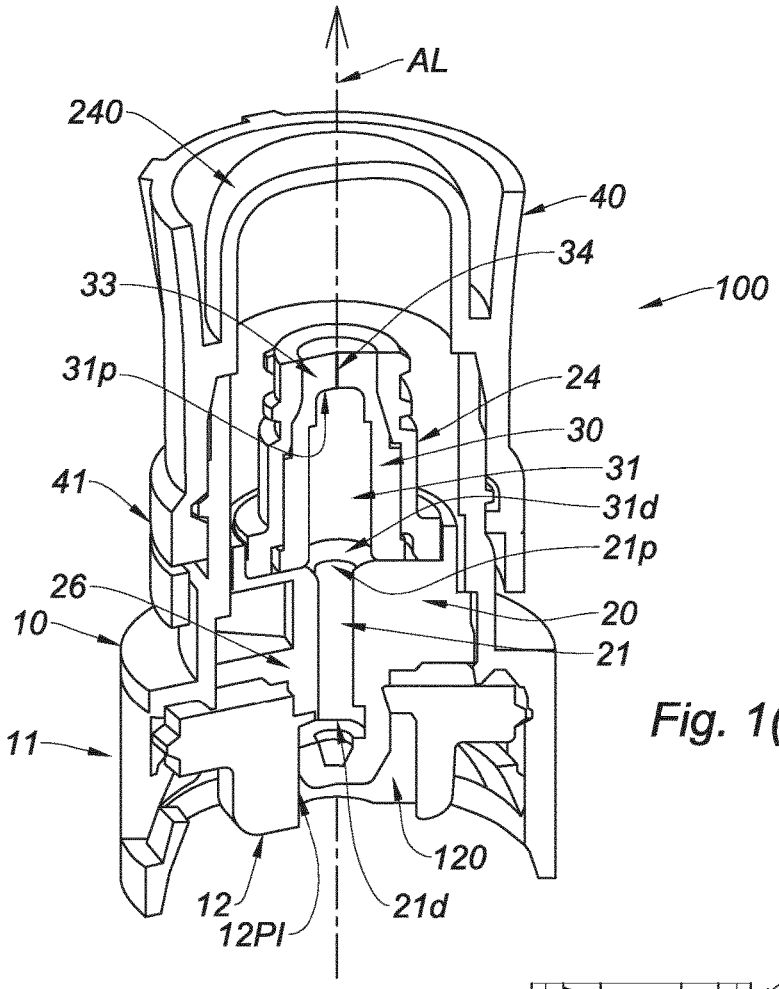
FIG. 1, which includes FIGS. 1(*a*) to 1(*g*), represents a first embodiment of a device according to the invention.
Figure 1F:
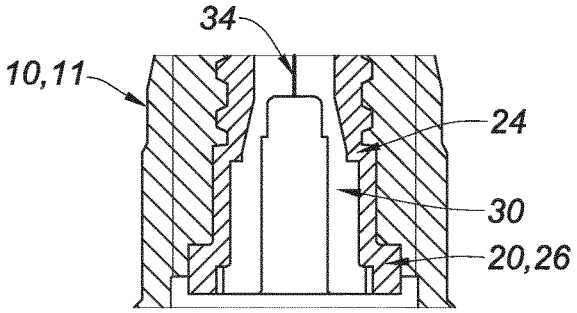
Figure 1G:
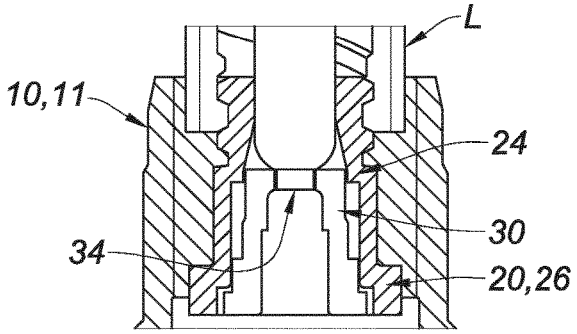
Figure 1D:
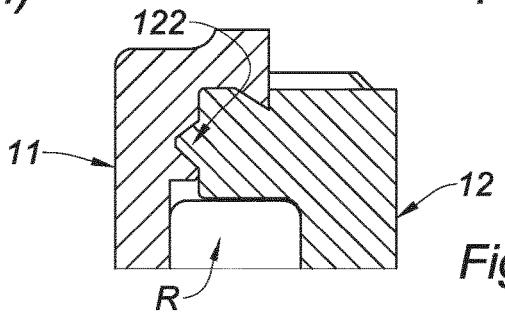
Figure 1B:
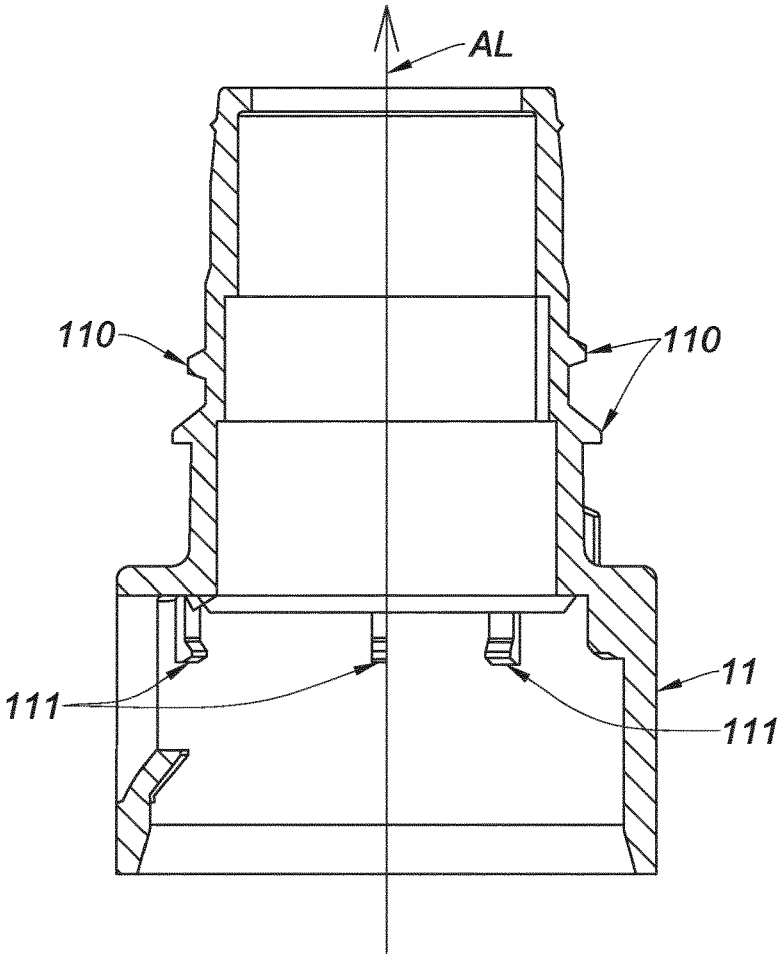

FIG. 1 represents a first embodiment of the invention.

Generally, the device 100 for sampling a liquid from a container according to the invention includes a housing 10, a component 20 located in the housing 10, an elastic valve 30 and a cap 40 detachably mounted on the housing 10. All these components are represented in the general perspective and sectional view, in FIG. 1(*a*).

The housing 10 includes a first base 11 intended to be mounted on the outside of the container and a second base 12 intended to be mounted on the inside of the container. The first base 11 is shown in a cross-sectional view in FIG. 1(*b*) and the second base 12 is shown in a cross-sectional view in FIG. 1(*c*). The bases 11 and 12 are mounted one on the other, according to an assembly preferably irremovable and without any relative movement being envisaged between them. A more detailed view of a fixing area for the two bases 11, 12 between them and on a container, R is shown in the cross-sectional view in FIG. 1(*d*). In this assembly, hook elements 111 of the first base are, for example, implemented to cooperate with an annular edge 122 of the second base 12. The assembly is designed to ensure a very good seal between the two bases 11, 12 so that the risk of liquid leakage or introduction of pollutants (such as liquids, dust or pollutants such as bacteria) between the two bases is limited. It should be noted that the second base 12 also includes a central hole 123 which accommodates part of component 20 and an upper wall 12SUP on which the component 20 is supported. As for the first base 11, it is hollow to accommodate the component 20 on the one hand and, in its lower part, the second base 12 on the other hand.

Advantageously, the assembly on the container R requires an axial compressive force F less than or equal to 300 N.

In addition, the connection between the sampling device according to the invention and the container R is advantageously non-detachable manually.

The component 20 is mounted in rotation with respect to the housing 10, i.e. with respect to both the first base 11 and second base 12, considering the fixing of the two bases 11, 12 one with respect to the other. This rotation is carried out between a closing position and an opening position. This rotation is carried out around the longitudinal axis AL of the housing 10. In practice, it is then advantageous to provide a rotation, between the closing position and the opening position, of 180° around this longitudinal axis AL.

The component 20 is more accurately represented in FIG. 1(*e*). This component 20 is also represented in its closing position in FIG. 1(*a*).

The component 20 includes a body 26 with at least one channel 21 with a proximal end 21*p* and a distal end 21*d*. The channel 21 passes through the body 26 of the component 20.

In the closing position (FIG. 1(*a*)), the distal end 21*d* of the at least one channel 21 is closed by the housing 10 and more precisely by an inner wall 12PI of the second base 12, inner wall which delimits the central channel 123 of this second base 12.

In the opening position (not shown), the distal end 21*d* of said at least one channel 21 is able to establish a fluid communication with the container. More precisely, when turning the component 20 about the longitudinal axis AL of the housing 10, from the closing position, for example by 180° C., the distal end 21*d* of said at least one channel 21 then arrives facing a passage 120 of the second base 12 opening, in this case towards the inside of a container when the device 100 is mounted on such a container R as shown in FIG. 1(*d*). The opening position corresponds to this situation where the liquid can pass from the container to the channel 21 of the component 20, through the passage 120 of the second base 12.

The component 20 also includes a receptacle 24 located in the extension of the proximal end 21*p* of said at least one channel 21. This receptacle 24 is fixed with respect to the body 26, and more precisely mounted fixed on the body 26. For example, to securely mount the receptacle 24 to the body 26, a circumferential groove 260 can be provided, located at the upper wall 26SUP of the body 26, and suitable for receiving, for example by snap-in, a corresponding wall of the receptacle 24.

Another type of assembly between the body 26 and the receptacle 24 can be considered, the essential being that this assembly, removable or not, allows a fixing preventing any relative movement between the body 26 and the receptacle 24.

In this respect, it is therefore possible, as an alternative, and for the receptacle 24 to be fixed with respect to the body 26, to provide that the receptacle 24 and the body 26 are of a single piece. This will not prevent the assembly of the elastic valve 30. Indeed, due to its elasticity, the elastic valve 30 can be accommodated inside the part formed by the receptacle 24 and the body 26, via the opening 240 of the receptacle 24.

Thus, the receptacle 24 allows the elastic valve 30 to be housed within the component 20. More precisely, the elastic valve 30 is held between the body 26 and the walls of the receptacle 24.

The elastic valve 30 is in shape complementarity with the inner wall of the receptacle 24. It also leans against the body 26.

This elastic valve 30 is advantageously made of elastomer, for example silicone elastomer.

It has a central orifice 31, a distal end 31*d* of which is in fluid communication with the proximal end 21*d* of said at least one channel 21 of the component 20. This fluid communication between the channel 21 and the central orifice 31 is present regardless of the angular position of the component 20 with respect to the housing 10.

The central orifice 31 also includes a proximal end 31 *p* which is in the form of a plug 33 provided with a slot 34. The slot 34 can be simple (straight) or complex (e. g. in the shape of an arc or star). When the elastic valve 30 is not stressed by an external action (Luer syringe or other), the slot 34 is closed and a seal is provided between the outside of the component 20 and the inside of the component 20. This is what is shown in FIGS. 1(*a*), 1(*e*) and 1(*f*). On the contrary, when the elastic valve 30 is stressed by an external action, it deforms axially, i.e. along the longitudinal axis AL of the housing 10. This is shown in FIG. 1(*g*). It is therefore understood that the elastic valve 30 is not fixed to the inner wall of the receptacle 24.

Moreover, when you wish to sample a liquid from a container equipped with a device as shown in FIG. 1, you start from a situation like that shown in FIG. 1(*a*). The cap 40 is removed from the housing 10 and more precisely from the first base 10.

A Luer L is introduced into the component 20, which has the effect (FIG. 1(*g*)) of compressing the elastic valve 30 axially and opening the slot 34 of the plug 33 at the proximal end 31*d* of the central channel 31 of the elastic valve 30. It is therefore understood that the elastic valve is not fixed to the inner wall of the receptacle 24.

Then, using the Luer L, the component 20 and elastic valve 30 are rotated, both in engagement with the Luer L. This rotation is done around the longitudinal axis AL of the housing 10. The longitudinal axis AL of the housing 10 then merges with the longitudinal axis of the Luer Las well as with that of the central channel 31 of the elastic valve 30. The component 20 then moves from its closing position to its opening position. In practice, the component 20 and more precisely the wall 261NF of the body 26 then slides against the upper wall 12SUP of the second base 12 of the housing 10. In the opening position, a passage then exists between the internal volume of the container and the Luer L. The liquid contained in the container can then be removed by the Luer L.

Once the liquid sampling from the container is complete, the user turns the Luer L in the opposite direction, always around the longitudinal axis AL of the housing 10, from the opening position to the closing position of the component 20. Once the closing position is reached, the user can remove the Luer L from the component 20. The elastic valve 30, which then no longer undergoes any external action, returns to its original shape, i.e. that of FIG. 1(*a*), thus closing the slot 34 of the plug 33 in a sealed manner.

The device 100 according to the invention provides a double sealing on the liquid sampling path.

The first sealing is carried out by a valve type system, in this case between the component 20 and the second base 20. The second sealing is achieved by an elastic valve 30 located above the valve type system.

The elastic valve 30 limits or prevents any introduction of pollutants into the upper part of the component 20, during, before or after use. In addition, the presence of a valve-type system between the container and the elastic valve 30 limits the stress on the latter and limits also the presence of liquid in channels 21 and 31.

In addition, when storing on the reverse side of a container R including the device for sampling a liquid according to the invention, the system in the closed valve position remains sealed and no leakage of the composition contained in the container is visible, even at high temperature, typically 40° C.

In addition, the fact of housing the elastic valve 30 in the component 20 makes it possible to implement a valve-type system with which the rotation of the component 20 with respect to the housing 10 is carried out around the longitudinal axis AL of the housing 10. The component 20 can therefore rotate in the housing 10, without a large space being present between the component and the housing 10, which limits the sizes, particularly radial, of the device and is therefore particularly well suited for a container. In addition, with this design, the Luer L can remain in the longitudinal axis of the housing 10, and therefore of the component 20 intended to rotate, without being obstructed by the container R. In addition, the rotation of the Luer L around this longitudinal axis to open or close the component 20 also causes the elastic valve 30 to rotate. This one therefore does not undergo any other stresses than the axial deformation printed by the Luer L.

In use, however, it is necessary to provide a certain torque to open the channel 21 and thus connect a puncture or collection system with the contents of the container. This operation must be easy, while giving the user the feeling of connection. In order to avoid the risk of contamination, the connection with the container is advantageously made once the connection between the sampling device and the Luer L is ensured. Advantageously, the assembly force of the Luer L on the sampling device according to the invention must be less than 27.5 N (during 5 sec) with an insertion torque of less than 0.1 N·m. The channel 21 is then opened once the Luer L link is effective, the opening torque being advantageously lower than 0.35 N·m. The closing channel 21 requires advantageously a torque lower than 0.35 N·m. Advantageously the disassembly force of the Luer L must be less than 27.5 N (during 5 sec) with a torque required to remove the Luer L lower than 0.1 N·m.

The cap 40 has a complementary shape with the housing 10 and more precisely the first base 11, for example to be screwed or unscrewed (elements 110 in FIG. 1(*b*) represent the threads of the first base 11).

The implementation torque of the cap 40 must be enough to ensure the closure of the liquid sampling device. A normally constituted adult person can provide a tightening torque on the cap 40 of about 1.1 N·m. Thus, and advantageously, the closure of the cap 40 is carried out for a torque lower than 1.1 N·m. Similarly, an opening torque on the cap of about 1.1 N·m. can be applied by a normally constituted adult person and advantageously the removal of the cap is achieved for a torque lower than 1.1 N·m.

The cap 40 can advantageously provide at least one tamper indicator 41 of the cap 40 compared to the housing 10. The tamper indicator 41 can take the form of an annular strip connected by frangible bridges (not visible in FIG. 1) to the first base 11 of the housing 10. The bridges are broken at the first opening of the cap 40.

Advantageously, the force required to tear the frangible bridges when the cap is first opened must be such that the system can be used by a normally constituted person. For example, for an opening diameter of the container R of 20 mm, the first opening torque of the system C is advantageously lower to 1.2 N·m.

It should be noted that while it is advantageous to provide a cap 40, its presence is not mandatory.

Figure 2A:
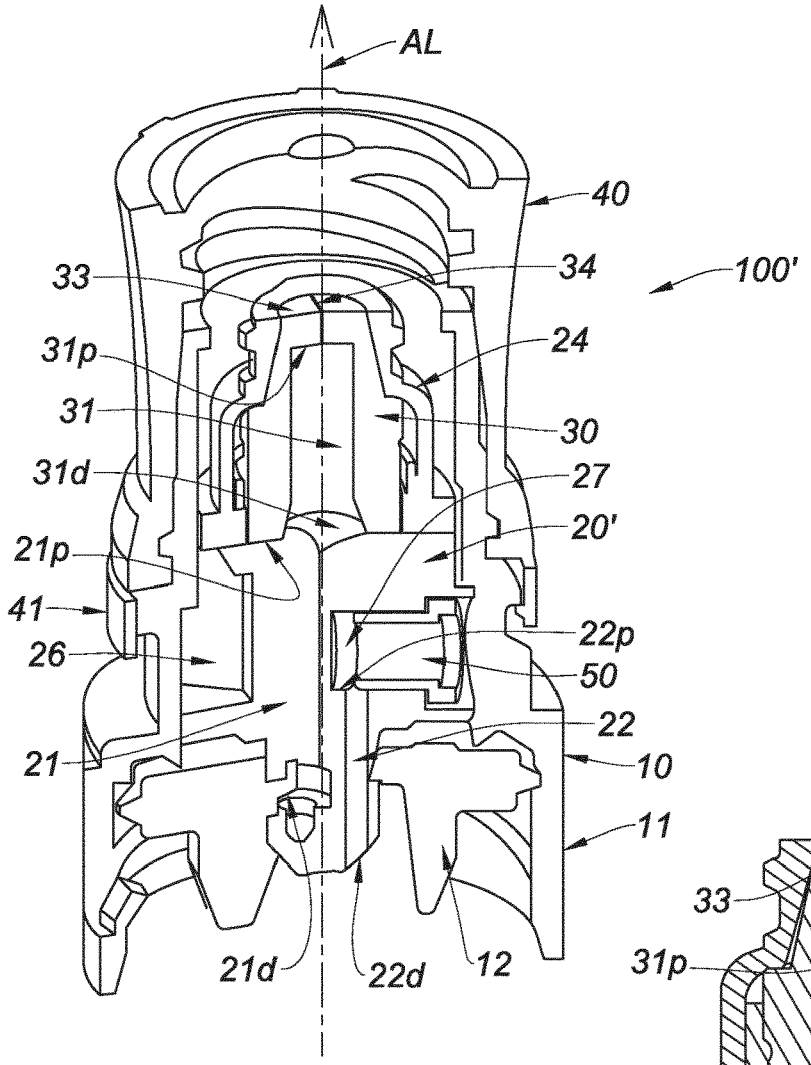
FIG. 2, which includes FIGS. 2(*a*) and 2(*b*), represents a second embodiment of the invention.
Figure 2B:
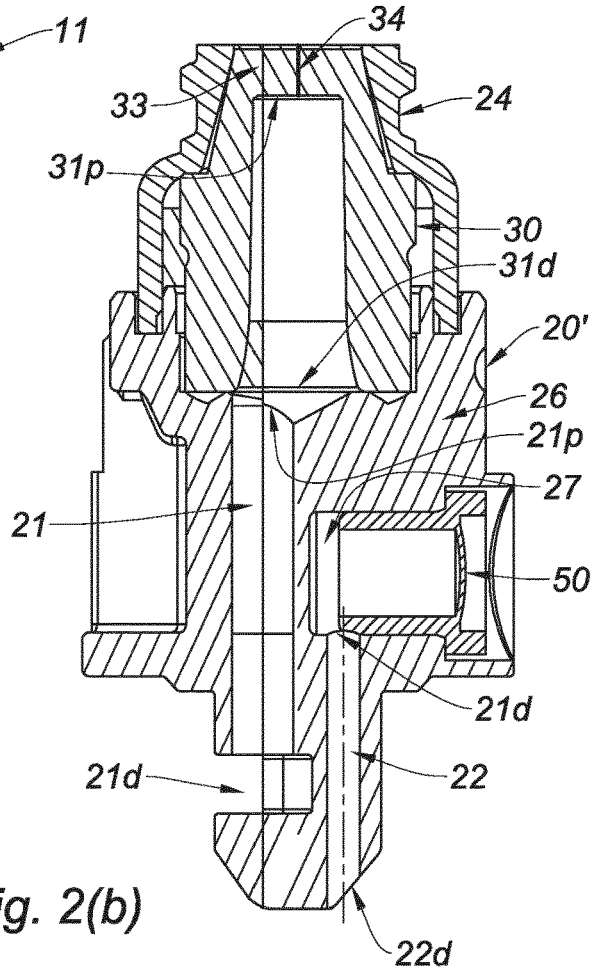
Figure 3A:
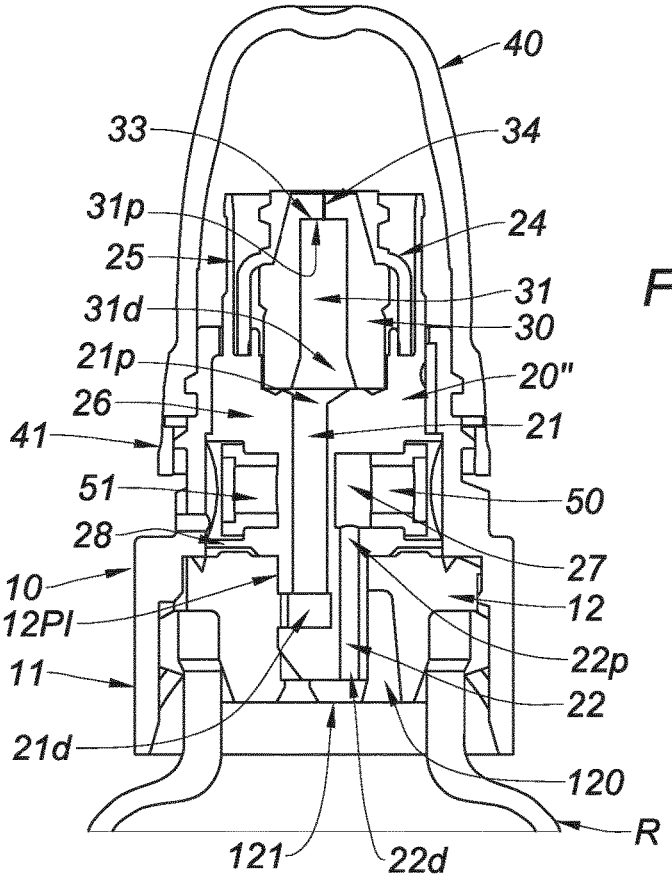
FIG. 3, which includes FIGS. 3(*a*) to 3(*d*), represents a third embodiment of the invention.
Figure 3B:
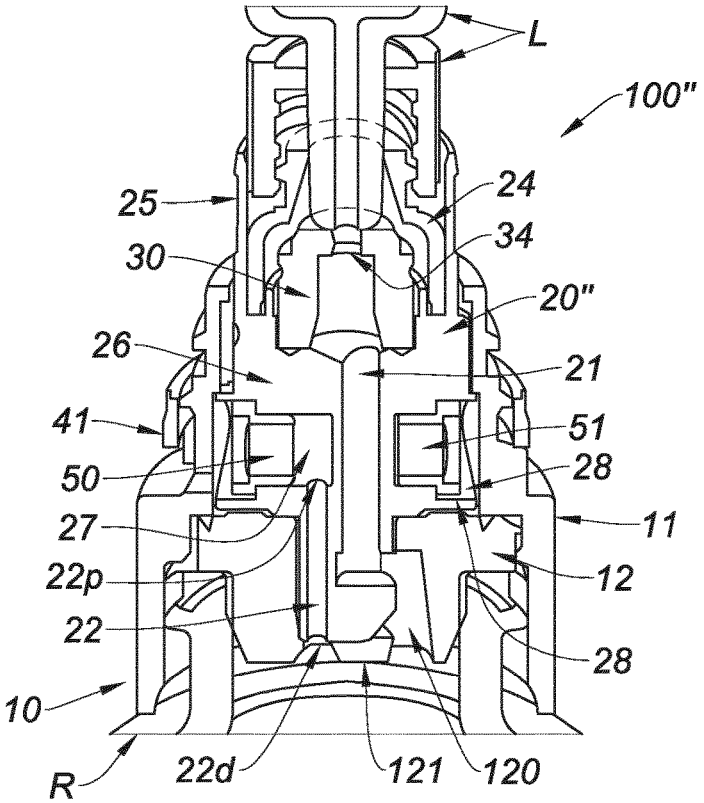
Figure 3C:
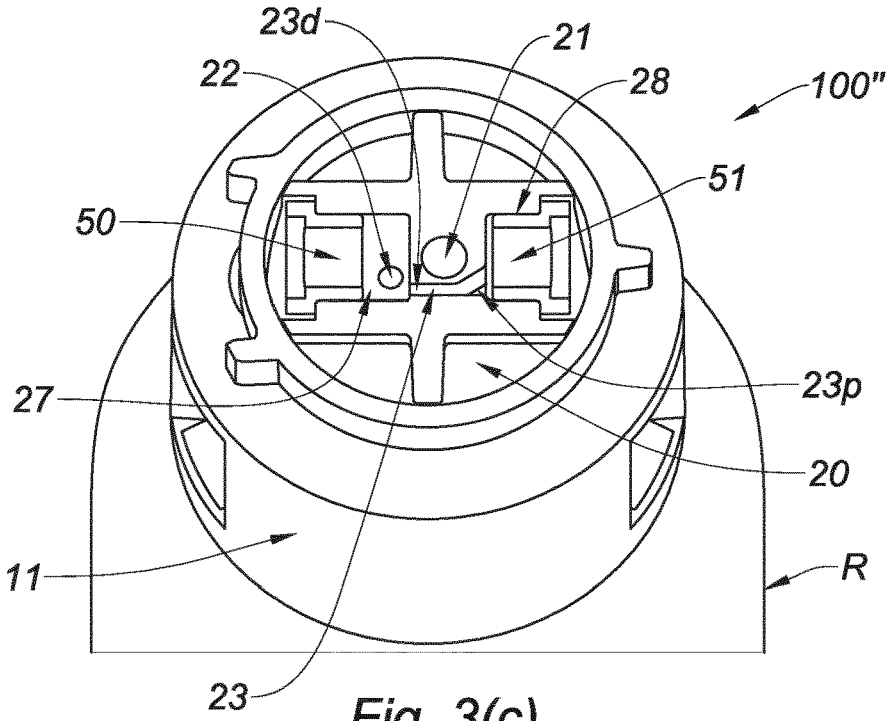
Figure 3D:
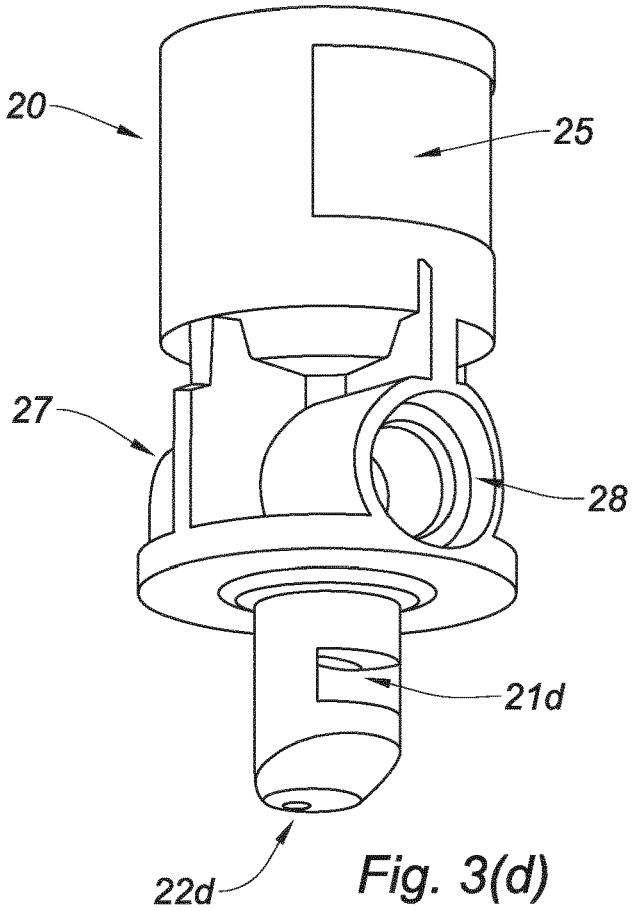

FIG. 2 shows a second embodiment of the invention.

This second embodiment takes the characteristics of the first embodiment. Also, compared to FIGS. 1(*a*) 1(*g*), the same elements have the same references.

However, this second embodiment includes additional characteristics.

Indeed, in this second embodiment, the body 26 of the component 20' is modified and includes a second channel 22 and a housing 27 in which the second channel 22 opens. More precisely, the distal end 22*d* of the second channel 22 can establish fluid communication with the container and the proximal end 22*p* of this second channel 22 opens into the housing 27, the latter including an air filter 50 in fluid communication with the outside air.

This allows the pressures to be balanced between the internal volume of the container and the outside, especially when sampling a liquid from the container. Indeed, by sampling a liquid from the container, and in the absence of an air intake on the outside, a vacuum is gradually created which makes it a little more difficult for the user to sample additional liquid. This occurs mainly when the container is rigid.

The air intake prevents this type of problem.

In addition, the air filter 50 filters the air taken from the outside to prevent it from polluting the liquid contained in the container, for example by adding dust or other contaminants that may pollute the contents of the container, such as bacteria.

In addition, it should be noted that the addition of this air intake, incorporating an air filter 50, does not change the size of the sampling 100' device compared to the first embodiment.

And when the component 20' is rotated, the air filter 50 which is located in the housing 27 defined in the body 26 of the component 20' accompanies the rotation movement.

According to a particularly advantageous embodiment, the air filter 50 is hydrophobic. This prevents intake of water in the container, thus protecting the contents from hydration. The air filter 50 can have different porosities and advantageously a porosity that allows the return of sterile air, when the pores (orifices) of the filter have a largest dimension less than or equal to 0.22 μm. In this way the sterility of the composition contained in the container R can be preserved. The air filter 50 can advantageously be hydrophobic and lipophobic (oleophobic). In this case, it limits or prevents the penetration and/or escape of both water and non-polar solvents such as lipids (fats).

FIG. 3 shows a third embodiment of the invention.

This third embodiment takes the characteristics of the second embodiment. Also, compared to FIGS. 1(*a*) to 1(*g*) and FIGS. 2(*a*) and 2(*b*), the same elements have the same references.

FIG. 3(*a*) shows, according to a cross-sectional view, a device 100" for sampling a liquid in a container when the component 20 is in its closing position. FIG. 3(*b*) shows, according to a cross-sectional view, this same device 100", but when the component 20 is in its opening position. FIG. 3(*c*) is a partial cross-sectional view of the air filters 50, 51. FIG. 3(*d*) shows, according to a perspective view, the component 20".

However, it includes additional characteristics.

Indeed, in this third embodiment, the body 26 of the component 20" is modified and includes a third channel 23 as well as another housing 28 in which the third channel opens. The third channel 23 allows an additional air intake between the outside of the container and the inside of the container through another air filter 51 which is housed in the housing 28.

Advantageously, the proximal end 23*p* of this third channel 22 opens into the housing 28 including the other air filter 51 and the distal end 23*d* of this third channel 23, able to establish a fluid communication with the container, opens into the housing 27 of the air filter 50. In this way, the outside air entering through the air filter 51 passes through the third channel 23, then through the second channel 22 before reaching the container. This design avoids the need for a third channel 23 identical to that of the second channel 22 and therefore makes the best use of the space available in the body 26 of the component 20".

Alternatively, however, a third channel 23 could be provided that is totally independent of the second channel 22.

Also, here, the other air filter 51, because of its insertion into a housing 28 of the component 20", follows the rotational movement of this component 20".

This additional air intake improves the speed of pressure balancing when sampling a liquid from the container, in particular for rigid containers, without impacting the overall sizes of the device 100".

According to a particularly advantageous embodiment, the air filter 51 is hydrophobic. This prevents intake of water in the container, thus protecting the contents from hydration. The air filter 51 can have different porosities and advantageously a porosity that allows the return of sterile air, when the pores (orifices) of the filter have a largest dimension less than or equal to 0.22 μm. In this way the sterility of the composition contained in the container R can be preserved. The other air filter 51 can advantageously be hydrophobic and lipophobic (oleophobic). In this case, it limits or prevents the penetration and/or escape of both water and non-polar solvents such as lipids (fats).

An additional characteristic provided for in the third embodiment concerns the addition of an air intake channel shutter 121 on the housing and more precisely on the second base 12 of this housing 10.

Indeed, the second base 12 has a shutter 121 for the second channel 22. Thus, when the component 20" is in its closing position (FIG. 3(*a*)), the second channel 22 is closed by this shutter 121, at its distal end 22*d*. In this case, it is recalled that the distal end 21*d* of the channel 21 intended of sampling a liquid is also closed by the inner wall 12PI of the second base 12. In addition, when the component 20" is in its opening position (FIG. 3(*b*)), the second channel 22 is open at its distal end 22*d*. In this case, it is recalled that the distal end 21*d* of the channel 21 then opens into the passage 120 of the second base 12, passage which opens into the interior of the container R.

The use of a shutter 121 provides additional safety when the component 20" is in its closing position. Indeed, if the container R is spilled, the liquid that cannot enter the closed channel 21 will also not be able to enter the second channel 22.

Another additional characteristic provided for in the third embodiment concerns the addition of a skirt 25, for example cylindrical, surrounding the receptacle 24. This skirt 25 can be made with the same material as the body 26 and therefore be molded at the same time as the body 26. This skirt allows, as can be seen in FIG. 3(*b*), to provide guidance for a Luer L. Indeed, the Luer L can be guided in the space defined between the receptacle 24 and the skirt 25. This facilitates the user's action in particular by preventing a misuse that would consist in applying the Luer L laterally, i.e. at an angle to the longitudinal axis (AL).

In addition, the presence of this skirt 25 can allow a user to ensure an opening or closing action of the component 20 manually and directly, i.e. without the use of a syringe of the Luer type or other, by handling the skirt 25 without touching the receptacle 24 or the plug 33. As a result, this actuation can be carried out without the user touching the elements likely to contact the liquid contained in the container. This ensures the cleanliness and/or sterility of the plug 33.

It should be noted that the invention is not limited to the three embodiment represented in the annexed figures.

Indeed, the invention covers other embodiments.

Thus, the skirt 25 of the component 20" surrounding the housing 24 for the elastic valve 30, discussed with the support of the third embodiment, can be added to the embodiment shown in FIG. 1 or the one shown in FIG. 2. Indeed, the function performed by the skirt 25 is also of interest in these cases.

Thus, the arrangement of the housing 10 allowing to close simultaneously, on the one hand, the channel 21 of the component 20", intended for the flow of the liquid contained in the container and, on the other hand, the channel 22 of air intake of the component 20" by a shutter, as discussed with the support of the third embodiment, can also be provided for a modified embodiment of FIG. 2. Indeed, the presence of a shutter 121 brings a benefit when an air intake is considered.

Regardless of the embodiment envisaged, an open or closed component status indicator 20, 20', 20" can be provided. To do this, it is enough to provide at least one opening O on the first base 11 allowing to see, through this opening, a part of the component 20 with a TV visual indicator of its status.

Figure 4A:
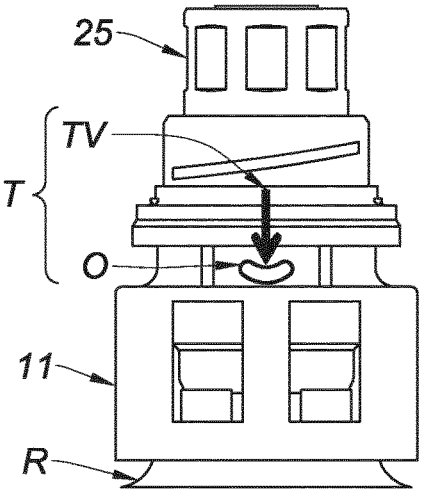
FIG. 4, which includes FIGS. 4(*a*) and 4(*b*), represents a possible embodiment for a status indicator of the opening/closing of the device according to the invention.
Figure 4B:
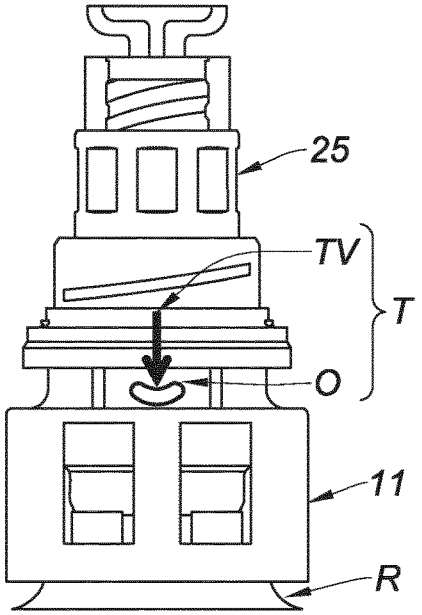
Figure 1E:
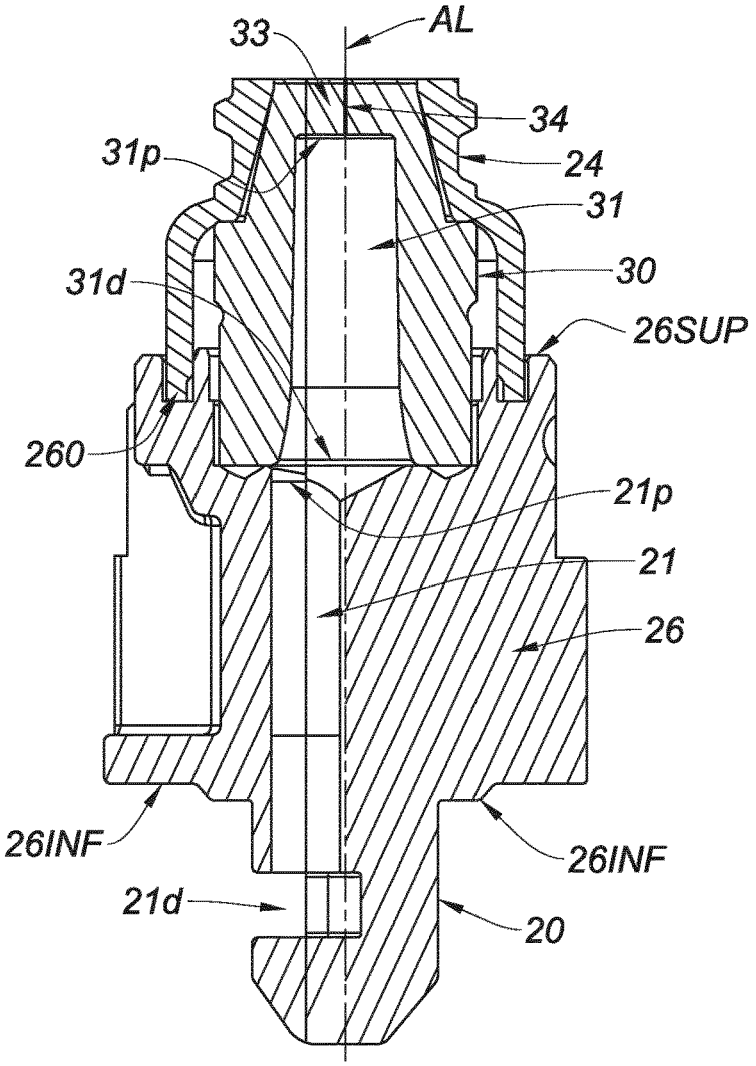
Figure 1C:
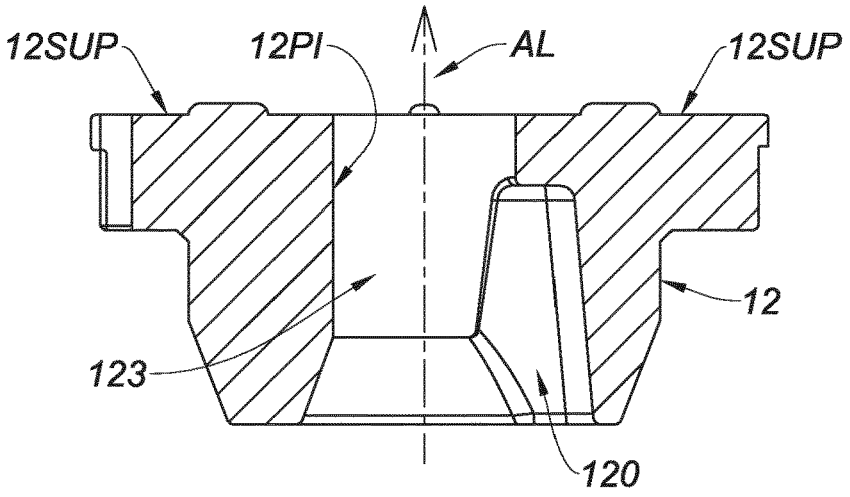

This is shown in FIG. 4, where FIG. 4(*a*) shows the closing position of the component 20, 20', 20" (red TV indicator for example) and FIG. 4(*b*) its opening position (green TV indicator for example).

This provides additional security for the user.

It is advantageous to also provide, on the first base 11, at least one barbican or opening, laterally with respect to the opening O, in order to allow the evacuation of any liquids collected behind the first base 11. Indeed, it has been found that when liquid is trapped behind the first base 11, its evaporation can bring, in contact with the filter(s), residues likely to reduce the effectiveness of the filters for balancing pressures between the inside and outside of the container R. The evacuation of liquids is increased by the presence of barbicans and the risk of filter quality degradation is reduced.

Different materials are possible to make the different elements of the device 100, 100', 100" according to the invention.

The first base 11 of the housing 10 can be realized in Acrylonitrile Butadiene Styrene (ABS), polycarbonate (PC) or poly(butylene terephthalate) (PBT). The second base 12 of the housing 10 and the elastic valve 30 can be made of thermoplastic elastomer (TPE), thermoplastic elastomer vulcanized (TPV), thermoplastic elastomer urethane (TPU), silicone, fluorosilicone, chlorobutyl, bromobutyl, nitrile, fluoroelastomer (FKM) or ethylene-propylene-diene monomer (EPDM). Advantageously, these elastomers can be coated with a protective film.

The component 20, 20', 20" (i.e. the body 26, receptacle 24 and, if applicable, skirt 25) can be made of poly(butylene terephthalate) (PBT), Polypropylene (PP) or Polyethylene Terephthalate (PET).

The cap 40 can be made in particular of polypropylene (PP).

These materials can be sterilized by conventional means. Advantageously, they can be irradiated or autoclaved.

It should be noted that in the above description, the housing 10 is presented as consisting of two bases 11, 12 mounted one on the other. As part of the invention, the housing 10 could be made of a single piece, a first part fulfilling the function of the first base 11 and a second part fulfilling the function of the second base 12. For example, it is possible to consider using a capsule that is crimped, clipped or screwed onto the opening of the container R. Advantageously, a device 100, 100', 100" for sampling a liquid according to the invention is non-dismountable in order to ensure the safety of children with respect to the composition contained in the container R or to ensure that the contents have not been modified.

Figure 5:
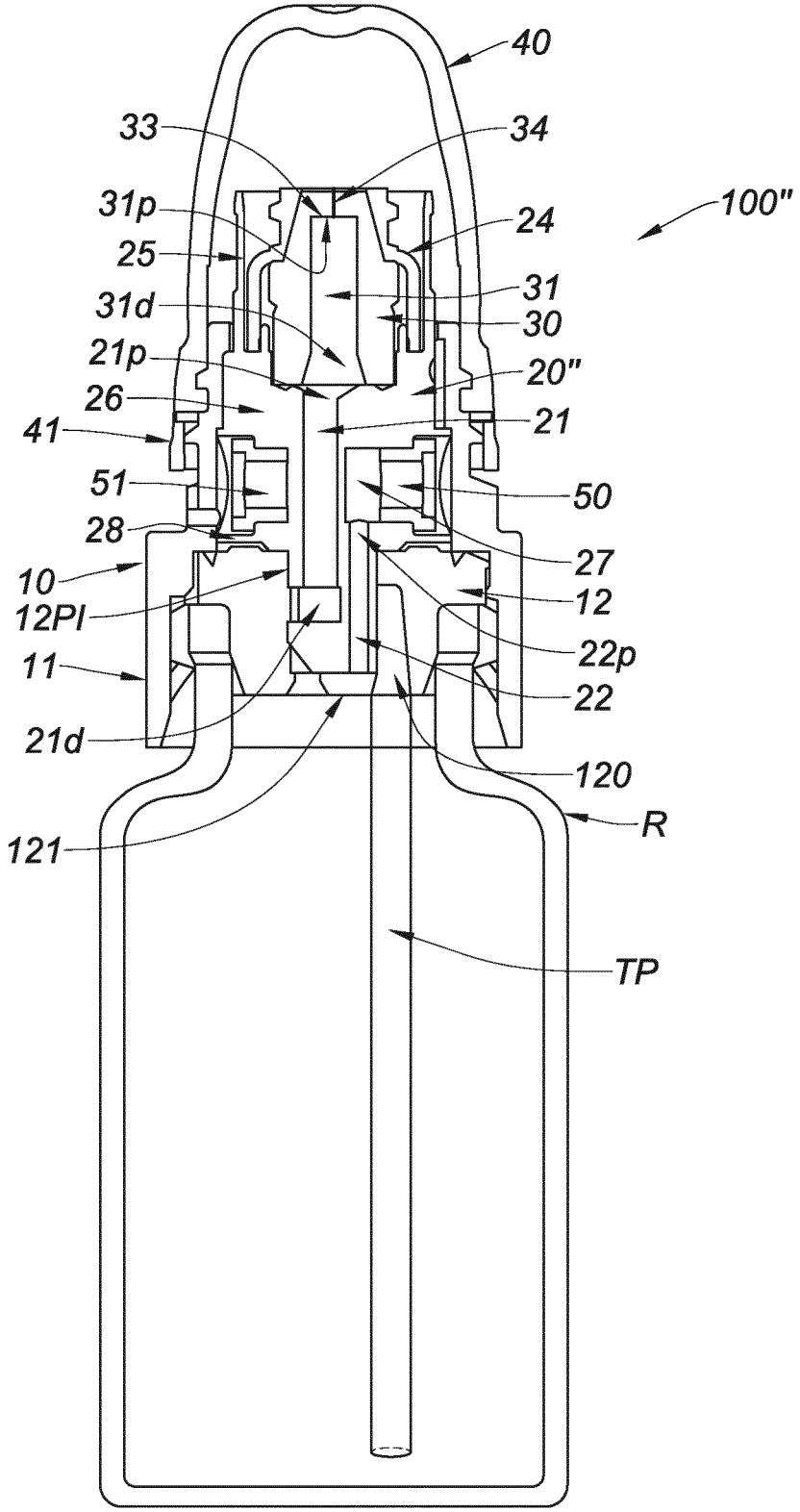
FIG. 5 is an embodiment variant in which a dip tube is shown.

The invention also concerns a container R having a liquid (solution or suspension) and an opening, said container R including, at its opening, a device 100, 100', 100" for sampling a liquid according to the invention. According an embodiment, the container R includes a flexible or rigid dip tube TP in connection with the distal end 21*d* of the body 26. Advantageously, the dip tube TP has a length corresponding to the height of the container R, which allows the composition contained in the container R to be sampled, with its head at the top. For example, the dip tube TP is shown in FIG. 5. This FIG. 5 corresponds in fact to FIG. 3(*a*), to which the dip tube TP has been added. Of course, such a dip tube can be considered whatever the embodiment considered.

The container R can be a bottle, a flask or a pouch.

The container R can be flexible or rigid. The material in which the container R is made can be glass or plastic (different types of plastics can be considered).

Finally, the invention also concerns the use of a container R including a liquid and provided with an opening and including, at its opening, a device 100, 100', 100" for sampling a liquid according to the invention as a packaging for a liquid consisting of a sterile pharmaceutical composition.

The invention also concerns the use, in the context of a curative or preventive therapeutic treatment, of a pharmaceutical composition contained in a container R including said pharmaceutical composition and an opening, said container R including, at its opening, a device 100, 100', 100" for sampling a liquid according to the invention. According to a particularly preferred embodiment of the invention, said use takes place in the veterinary field to administer a sterile pharmaceutical composition to an animal.

The invention claimed is:

1. A device for sampling a liquid from a container, comprising a housing having a longitudinal axis;

a component including:

a body provided with at least one channel with a proximal end and a distal end;

a receptacle, fixed with respect to the body, and located in an extension of the proximal end of said at least one channel, said component being mounted in rotation with respect to the housing about the longitudinal axis of this housing between a closing position in which the distal end of said at least one channel is closed by the housing and an opening position in which the distal end of said at least one channel is capable of establishing a fluid communication with the container; and an elastic valve housed in the receptacle.

2. The device according to claim 1, wherein the elastic valve include a central orifice, one distal end of which is in fluid communication with the proximal end of said at least one channel of the component and one proximal end of which is in the form of a plug provided with at least one slot.

3. The device according to claim 1, wherein the elastic valve is made of elastomer.

4. The device according to claim 1, wherein the component includes a skirt surrounding the receptacle.

5. The device according to claim 1, wherein the body of the component includes a first body housing and at least one second channel, one proximal end of which opens into the first body housing, which first body housing includes an air filter in fluid communication with the outside, and a distal end of which is capable of establishing a fluid communication with the container.

6. The device according to claim 5, wherein the component includes a second body housing and at least one third channel, one proximal end of which opens into the second body housing, which second body housing includes another air filter in fluid communication with the outside, and one distal end of which is capable of establishing fluid communication with the container.

7. The device according to claim 6, wherein the distal end of said at least one third channel opens into the second body housing.

8. The device according to claim 5, wherein the or each air filter is hydrophobic and lipophobic.

9. The device according to claim 5, wherein the or each air filter has orifices whose largest dimension is less than or equal to 0.22 μm.

10. The device according to claim 5, wherein the first body housing includes a shutter for closing the distal end of said at least one second channel and/or said at least one third channel when the component is in its closing position.

11. The device according to claim 1, wherein the device includes an indicator of the closing or opening position of the component.

12. The device according to claim 1, wherein the device further includes a cap detachably mounted on the housing.

13. The device according to claim 1, wherein the device includes a tamper indicator of the cap with respect to the housing.

14. The device according to claim 1, wherein the housing includes:

a first base intended to be mounted on the outside of the container; and a second base intended to be mounted on the inside of the container, said second base, which is in one piece or cooperates with the first base, forming the part of the housing with which the component cooperates to move from its closing position to its opening position and vice versa.

15. A container including a liquid and an opening, said container comprising, at its opening, a device for sampling a liquid according to claim 1.

16. The container according to claim 15, said container including a dip tube in connection with the distal end of the body.

17. The container according to claim 15, wherein the container is packaging for a liquid consisting of a sterile pharmaceutical composition.

* * * * *